US005702107A

United States Patent [19]

Novak

[11] Patent Number: 5,702,107

[45] Date of Patent: Dec. 30, 1997

[54] TOY VEHICLE GAME AND METHODS OF PLAYING THE GAME

[76] Inventor: Joseph R. Novak, Box 15, (Stone Church) Rd., Merrittstown, Pa. 15463

[21] Appl. No.: 782,252

[22] Filed: Jan. 14, 1997

[51] Int. Cl.[6] ..... A63B 67/00; A63H 17/02

[52] U.S. Cl. ..... 273/442; 273/359; 446/6

[58] Field of Search ..... 273/442, 359; 446/6

[56] References Cited

U.S. PATENT DOCUMENTS

| | | | |
|---|---|---|---|
| D. 366,296 | 1/1996 | Novak | D21/136 |
| 3,201,898 | 8/1965 | Lahr et al. . | |
| 3,734,500 | 5/1973 | Cooper . | |
| 4,295,292 | 10/1981 | Fitzgerald et al. . | |
| 4,898,382 | 2/1990 | Lamanna . | |
| 4,911,669 | 3/1990 | Parker | 446/6 |
| 4,938,483 | 7/1990 | Yavetz | 463/5 |
| 5,100,153 | 3/1992 | Welte | 273/357 |
| 5,100,155 | 3/1992 | Lamanna Egidio | 273/442 |
| 5,251,910 | 10/1993 | Lamanna | 273/442 |

*Primary Examiner*—William H. Grieb
*Attorney, Agent, or Firm*—Nixon & Vanderhye

[57] ABSTRACT

Toy vehicles for the game include a plurality of targets on each vehicle movable between first and second positions. Switches are associated with the respective targets and in closed positions connect a battery in parallel to a motor for running the toy vehicle. Each vehicle has a protrusion for impacting against the target of another vehicle. Upon impact, the target is moved to a second position opening the switch. The circuit provides for the continued running of each vehicle until the last target is impacted and its switch is opened, at which time the power circuit is opened and the vehicle stops. The game is played in the form of a demolition derby in which the last vehicle running is the winner.

18 Claims, 4 Drawing Sheets

Fig. 2
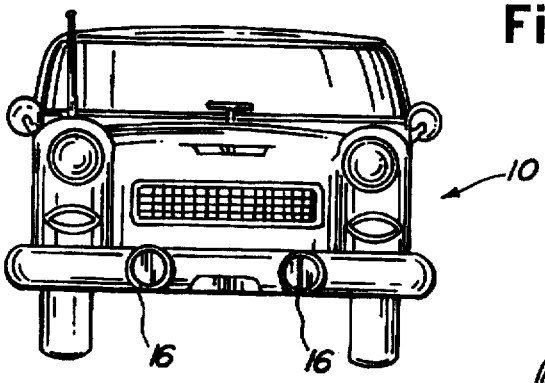
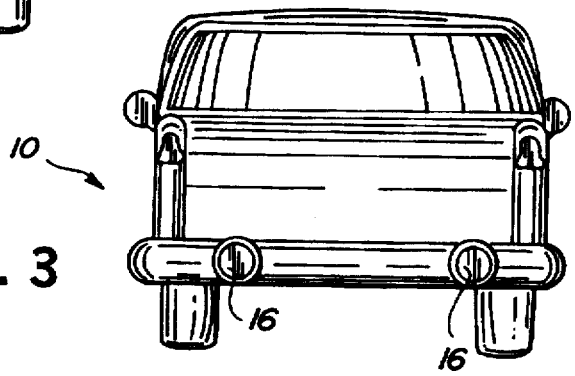
Fig. 3
Fig. 4
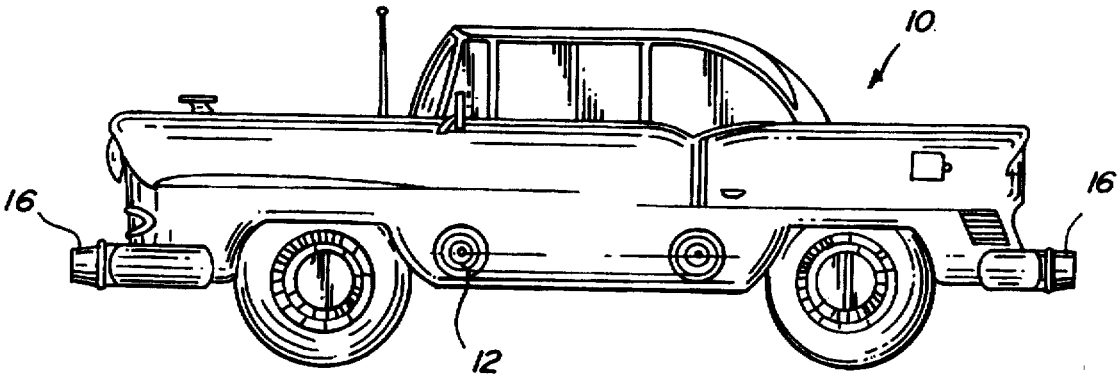

TOY VEHICLE GAME AND METHODS OF PLAYING THE GAME

TECHNICAL FIELD

The present invention relates to a plurality of individually remotely controlled toy vehicles for use in a game, for example, a demolition derby-type game, and a method of playing the game.

DISCLOSURE OF THE INVENTION

Many and different types of toy vehicles have been proposed and constructed in the past. Many such vehicles are provided with a motor and a power source, i.e., battery, carried by the vehicle whereby the vehicle can be operated to move along a surface. Such vehicles are often stand-alone vehicles in that once the vehicle is released, the vehicle is without directional control. There are also various types of remote control devices for controlling the direction of vehicle movement once released. For example, radio-controlled and wire-guided toy vehicles, have been proposed and constructed in the past. The present invention is of the latter remote-control type, wherein the direction of movement of the toy vehicles employed in the game hereof can be controlled remotely by any one of the known remote control devices such as radio control or control by wire.

Remote-control vehicles have also been previously employed in games, e.g., a demolition derby. One such game, as described in U.S. Pat. No. 4,295,292, employs removable elements on a plurality of toy vehicles. As the toy vehicles are moved about a gameboard by manually-operated magnetic manipulators disposed under the gameboard, the impact between vehicles causes the elements to drop from the vehicles. A similar type game is disclosed in U.S. Pat. No. 3,734,500, wherein impact of toy vehicles with one another causes disassembly of the vehicle. A bumper car type game has also been proposed in U.S. Pat. No. 5,251,910.

In accordance with the present invention, there is provided a plurality of toy vehicles which are individually powered and directionally controlled by remote control such as radio or wire control. Each vehicle is provided with a plurality of targets as well as one or more protrusions for impacting a target. A switch is associated with each target and is connected between the power source, e.g., a battery, and the vehicle motor. The circuitry is arranged such that the vehicle will operate with energy being supplied the motor from the power source until all of the switches are moved from a closed position into an opened position. That is, power is supplied from a battery connected in parallel to the motor through a plurality of switches which are normally closed when the game is being played and which switches are opened one after the other or in groups as the game is played until the last switch is opened. As the switches are opened upon impact on the targets by another vehicle, the vehicles continue to run until the last switch is opened, at which time the power circuit is opened, disconnecting the motor and the battery, causing the vehicle to stop.

To accomplish the foregoing, the targets are spaced one from the other on each vehicle and are movable between a first position which corresponds to a switch-closed position into a second position which corresponds to a switch-opened position. The targets in the first position may be flush with, project from or be recessed into the outside surface of the vehicle body. Particularly, the target, which may comprise, for example, a disk serving as a bull's-eye, is spring-biased into the first position. The disk is movable into the second position upon impact by the protrusion of another vehicle, causing the normally closed switch to open. Upon impact and movement into the second position, the target is detented in the second position to maintain the switch associated therewith in an open position. Consequently, the switches are moved to open positions as the targets are impacted until the last switch is opened, at which time the power circuit opens and the toy vehicle stops.

The game to be played in accordance with the present invention is in the form of a demolition derby with the winner of the game being the last player whose toy vehicle is still running at the end of the derby. With a plurality of vehicles starting the derby, each under control of an individual player, a player maneuvers his/her vehicle in a way to impact the protrusion or protrusions of his/her controlled vehicle into the targets of another vehicle in efforts to open the switches of the other vehicle upon impact with its targets. Each instance of impacting the protrusion of one vehicle against a target of another vehicle opens the associated switch of the other vehicle and locks the impacted target in a switch-open position. Consequently, each vehicle, upon impact against its last target having its associated switch in a closed position, will be disabled from running until only one vehicle remains. The last remaining vehicle still able to run wins the game.

A further feature of the present invention resides in the ready and quick reactivation of the toy vehicles for use in the next game. Each target, when moved to its second position, is locked in that position by a detent, e.g., a leaf spring detent which releasably holds the target in its second open position. When it is desired to reactivate the toy vehicle, the detent can be manually released by a player whereupon the main spring biases the target into its first position, closing the associated switch and enabling power to be provided from the battery to the motor.

A specific feature of the present invention resides in the spacing of the targets and the protrusions along each vehicle. The targets are spaced a predetermined distance one from the other, for example, along opposite sides of the vehicle. Each vehicle may also have a pair of protrusions on its front or rear end, or both, which are spaced the same predetermined distance from one another. Consequently, when the front end of one vehicle impacts the side of another vehicle, there is the possibility that the pair of protrusions on the front end of the one vehicle will simultaneously impact the pair of targets on the side of the other vehicle whereby two switches are moved from their closed to their opened positions. Accordingly, skillful players will attempt to maneuver their vehicles to broadside other vehicles with the possibility of closing two switches, rather than one, on impact with such other vehicle.

In a preferred embodiment according to the present invention, there is provided a method of playing a game have a plurality of toy vehicles each having a motor, comprising the steps of providing a plurality of targets at spaced locations on each vehicle, and for each vehicle, providing a plurality of normally closed switches connecting a source of power for driving the vehicle and the motor of the vehicle. The method also includes coupling the switches and the targets to one another on each vehicle such that the switches are individually opened in response to an impact on a target of the vehicle and moving at least one vehicle to impact all of the targets of another vehicle to open all of the switches of another vehicle, thereby deactivating the motor thereof and stopping another vehicle.

In a further preferred embodiment according to the present invention, there is provided a toy vehicle comprising a toy vehicle body, a motor carried by the body and a source of power carried by the body for powering the motor, a plurality of targets carried by the vehicle body at spaced locations thereabout and movable between first and second positions, a plurality of normally closed switches carried by the vehicle connecting the source of power and the motor such that the motor receives power from the power source through the switches until all the switches lie in an open position disconnecting the power source and the motor, the switches being coupled to the targets, respectively, and movable into open positions in response to movement of the targets from the first positions to the second positions whereby the vehicle is powered until a last of the switches is opened.

In a still further preferred embodiment according to the present invention, there is provided a toy vehicle comprising a toy vehicle body, a motor carried by the body and a battery carried by the body for powering the motor, a plurality of targets carried by the vehicle body at spaced locations thereabout and movable between first and second positions, a plurality of switches carried by the vehicle connecting in parallel the battery and the motor such that the motor receives power from the battery through the switches when closed, the switches being coupled to the targets, respectively, and movable into open positions in response to movement of the targets from the first position to the second position enabling the vehicle to be powered by the battery until a last of the switches is opened.

Accordingly, it is a primary object of the present invention to provide a toy vehicle game and method of playing the game and particularly a game in the form of a demolition derby wherein vehicles under remote control by each player are impacted against targets on other vehicles whereby, when the last target of a vehicle is impacted, the vehicle stops running and the last vehicle running wins the game.

BRIEF DESCRIPTION OF THE DRAWINGS

FIGS. 2, 3 and 4 are front, rear and side elevational views of a vehicle according to the present invention;

BEST MODE FOR CARRYING OUT THE INVENTION

Figure 1:
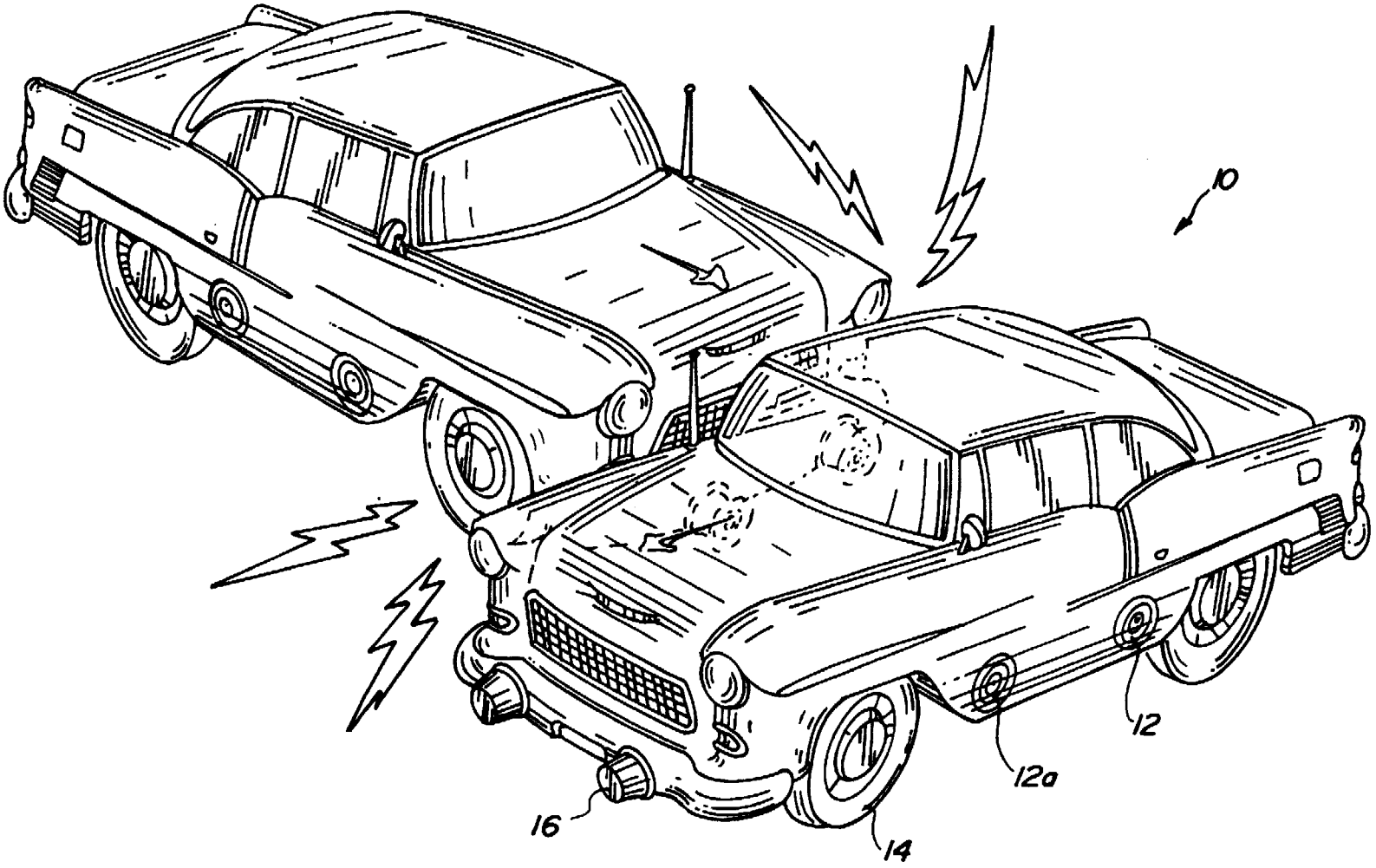
FIG. 1 is a perspective view illustrating a toy vehicle impacting against another toy vehicle in playing a game according to the present invention.
Figure 5:
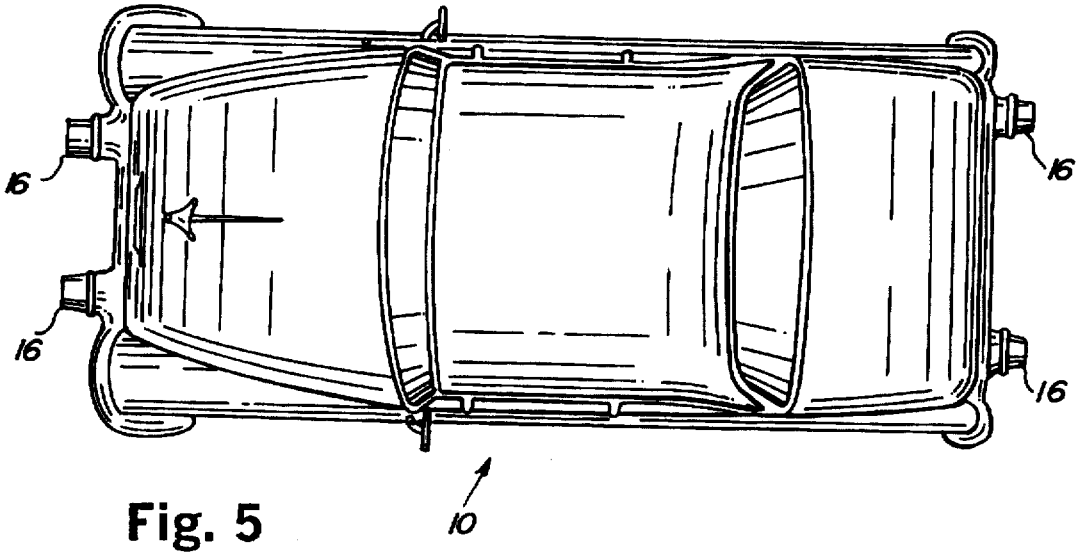
FIG. 5 is a top plan view of a vehicle according to the present invention.

Referring now to the drawings, particularly to FIG. 1, there is illustrated a pair of toy vehicles 10, preferably of identical construction with one another, with one vehicle impacting against another vehicle. These toy vehicles 10 each have a vehicle body which may comprise any body type, for example, a car or truck and any body style. As best illustrated in FIGS. 1 and 4, each vehicle is provided with one, and preferably a plurality of targets spaced one from the other about the vehicle body. For example, in FIGS. 1 and 4, a pair of targets 12 are provided on each of the opposite sides of the vehicle body and between the vehicle wheels 14. It will be appreciated that the targets can be located at other positions about the vehicle body, for example, along the sides forwardly and rearwardly of the front and rear wheels and/or on the front or back of the vehicle, or both, as desired. The targets 12 are for the purpose of providing an impact area for another vehicle in the game which, when impacted, result in the opening of a switch in the power circuit driving the vehicle, as described below.

Also, as illustrated in FIGS. 1–5, each of the vehicles 10 has one or more protrusions 16 on the front end or back end, or both. Each protrusion 16 projects from the vehicle body sufficiently such that the protrusion will engage, i.e., impact against another vehicle and, in accordance with the present game, against a target 12 of such other vehicle. One of the features of the present invention resides in the spacing of the protrusions 16 in a manner corresponding to the spacing between the targets 12 of other vehicles. For example, in FIG. 3, the protrusions 16 along the rear bumper of the toy vehicle are spaced one from the other a distance corresponding to the spacing of the targets 12 along the side of the vehicle. Thus, it is possible when backing the toy vehicle 10 into another vehicle to cause the protrusions 16 to simultaneously engage and impact against the pair of targets 12 on the other vehicle. Conversely, the protrusions 16 on the front end of the vehicle illustrated in FIG. 2 may be spaced wider or narrower relative to one another such that the protrusions are not spaced correspondingly to the spacing between the targets 12 along the sides of the vehicle. Consequently, a front end impact of one vehicle against a side of another vehicle may only engage one of the protrusions against one of the targets. It will be appreciated, however, that all of the protrusions on each of the front and rear ends of the vehicles may be equally spaced from one another and either corresponding or not corresponding to the spacing of the targets on the vehicles.

Figure 7:
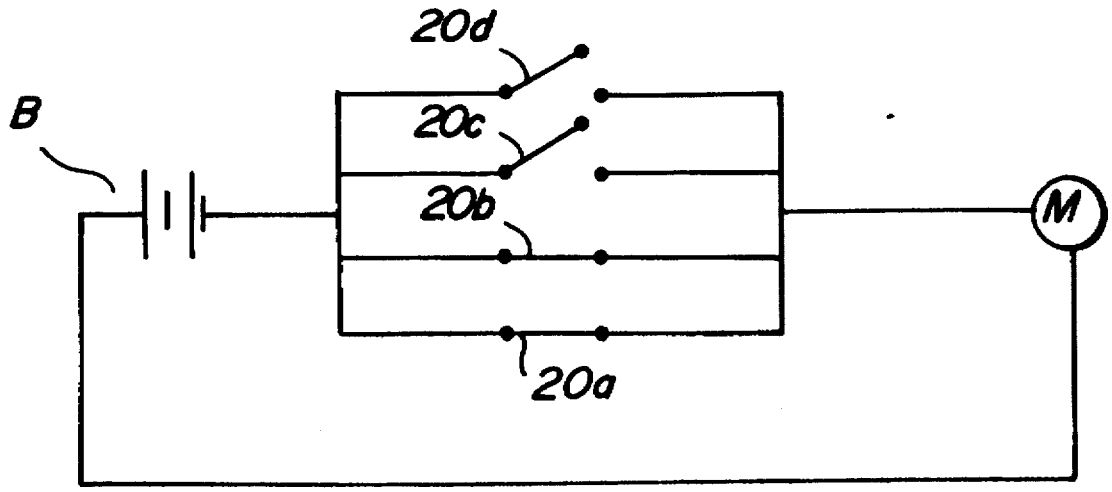
FIG. 7 is a circuit diagram for use in each vehicle of the present invention.

Referring now to FIG. 7, there is illustrated an electrical circuit for powering each toy vehicle 10. The circuit includes a motor M which is coupled in parallel through a plurality of switches 20*a*–20*d* with a battery B. It will be appreciated that with at least one of the switches 20*a*–20*d* in a closed position (two being disclosed in a closed position, while two others are disclosed in an open position), a complete circuit between the battery B and the motor M is provided. Thus, with at least one switch closed in the circuit, power from battery B is continuously supplied motor M whereby the vehicle can be operated. The toy vehicles 10 are remotely controlled, for example, radio-controlled in a conventional manner whereby the vehicles can be caused to move forwardly, rearwardly and turned. Also, accelerating and decelerating movements of the toy vehicles can be remotely controlled, all as conventional. Consequently, from a review of FIG. 7, it will be appreciated that the vehicles will continue to run until the last of the switches 20*a*–20*d* is opened and all of the other switches are opened whereby the power from battery B to motor M is open-circuited.

Figure 6:
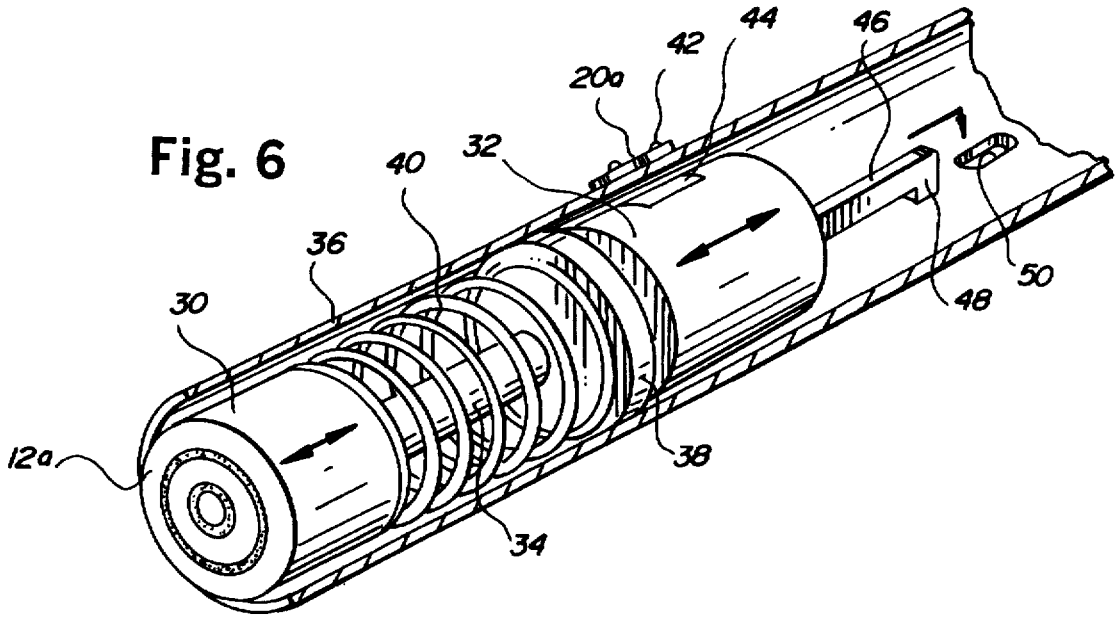
FIG. 6 is a perspective view illustrating a target and switch mechanism of the present invention.

Referring now to FIG. 6, each of the targets 12 is associated with one of the switches 20*a*–20*d*, thus, for example, switch 20*a* may be associated with a target 12*a* formed on the side of the toy vehicle. The target 12*a* as illustrated in FIG. 6 comprises a disk 30 and a piston 32 coupled one to the other by a shaft 34 disposed within a tubular housing 36. The shaft 34 passes through a cylindrical wall section 38 fixed to housing 36. A main spring 40 is disposed between fixed wall 38 and disk 30 biasing the disk 30 into a first position, for example, with the outer surface of disk 30 lying flush along the vehicle body as illustrated in FIG. 1. With this arrangement, it will be appreciated that any impact on target 12*a* by the protrusion on another vehicle will displace the disk 30 and piston 32 inwardly against the bias of coil spring 40.

The switch 20*a* disposed along the housing 36 comprises a pair of contacts 42 which, along the inner surface of housing 36. bear against a conductive member 44. Consequently, when the disk 30 lies in its first position, the conductive element 44 engages the contacts of switch 20*a* to maintain the switch 20*a* in a normally closed position. By a normally closed position is meant the position of the switches when the game is being played or about to be played. Obviously, when the game is not being played, either all of the switches can be opened in the manner set forth below or a master on/off switch can be interposed between the switches 20*a*–20*d* and either the battery or motor. When the target 12*a* is displaced, for example, when impacted by a protrusion 16, the conductive element 44 will be displaced rearwardly, i.e., left to right in FIG. 6, opening the switch 20*a*.

A leaf spring 46 extends from the rear face of piston 32 and has a hook 48 at its distal end. The tubular housing 36 also has a slot 50 for receiving the hook 48 when the disk 30 and piston 32 are displaced inwardly into a second position opening the switch. Consequently, when the target is impacted and the piston 32 is displaced inwardly, the hook 48 engages in the slot 50 to detent the target in its second switch-opened position. The housing 36 is arranged on the vehicle body such that the slot 50 is exposed, for example, along the underside of the vehicle body. By pressing inwardly on the hook 48 by a player's finger or an instrument, the hook 48 can be disengaged from the slot 50, enabling the spring 40 to return the target 12*a* to its normal position corresponding to a switch-closed position. It will be appreciated that the number of targets and corresponding switches may vary and that the number illustrated is by way of example only and may vary.

The manner in which the game is to be played will now be described. Each player is provided with a toy vehicle and a remote control for the vehicle. While a game board can be provided, it is not necessary, as any playing surface, such as a floor or a rug will suffice. The object of the game is to disable each of the other player's toy vehicles by impacting against the targets on such vehicles to open all of their switches such that the other vehicles are disabled from running. Thus, the last toy vehicle running in the game is the winner of the game.

To start the game, each player ensures that all of the targets are in their first position and all of the switches of their respective vehicles are in a closed position. The cars are then controlled by the players to impact other cars by impacting the protrusions 16 against the targets 12 of the other cars. When a protrusion impacts a target, the target is moved from its first position into a second position and detented in the second position. Also, the switch associated with the impacted target will now be detented in the switch-open position. Consequently, it will be seen that when all of the targets of a particular vehicle have been impacted by protrusions of other vehicles, the switches will be opened, forming an open circuit, thereby disabling the vehicle. The winner of the game is thus the player who maintains his vehicle running when all other vehicles have been disabled, notwithstanding that the winner's vehicle may have one or more of its switches displaced to an open position, so long as one of its switches remains closed whereby the vehicle can be operated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of playing a game have a plurality of toy vehicles each having a motor, comprising the steps of:

providing a plurality of targets at spaced locations on each vehicle;

for each vehicle, providing a plurality of normally closed switches connecting a source of power for driving the vehicle and the motor of the vehicle;

coupling said switches and said targets to one another on each vehicle such that the switches are individually opened in response to an impact on a target of the vehicle; and moving at least one vehicle to impact all of the targets of another vehicle to open all of the switches of said another vehicle, thereby deactivating the motor thereof and stopping said another vehicle.

2. A method according to claim 1 including providing at least one protrusion on each vehicle to impact a target on another vehicle.

3. A method according to claim 1 including providing at least a first protrusion on the front end of said one vehicle to impact a target on said another vehicle while moving said one vehicle in a forward direction.

4. A method according to claim 1 including providing a protrusion on the rear end of said one vehicle to impact a target on said another vehicle while moving the vehicle in a rearward direction.

5. A method according to claim 1 including providing a pair of protrusions on each vehicle spaced a predetermined distance from one another and a pair of targets on each vehicle spaced said predetermined distance from one another such that impact of said pair of protrusions on said one vehicle substantially simultaneously on said pair of targets of said another vehicle substantially simultaneously opens the switches associated with said pair of targets.

6. A method according to claim 1 including retaining switches individually opened in said switch-opened positions.

7. A method according to claim 6 including returning said switches from said switch-opened positions to said closed positions.

8. A method according to claim 1 including displacing said targets from switch-closed to switch-opened positions, and returning said targets from said switch-opened positions to said switch-closed positions.

9. A toy vehicle comprising:

a toy vehicle body;

a motor carried by said body and a source of power carried by said body for powering the motor;

a plurality of targets carried by said vehicle body at spaced locations thereabout and movable between first and second positions;

a plurality of normally closed switches carried by said vehicle connecting said source of power and said motor such that said motor receives power from said power source through said switches until all said switches lie in an open position disconnecting the power source and said motor, said switches being coupled to said targets, respectively, and movable into open positions in response to movement of said targets from said first positions to said second positions whereby the vehicle is powered until a last of said switches is opened.

10. A toy vehicle according to claim 9 including a device for locking each target in said second position upon movement from said first position into said second position.

11. A toy vehicle according to claim 10 wherein said device includes a manually operable release for releasing the target from said second position for movement to said first position.

12. A toy vehicle according to claim 9 including a spring for biasing each target into said first position, a detent cooperable between said vehicle body and said target for releasably securing said target in said second position, said detent being responsive to movement of said target into said second position to lock said target in said second position.

13. A toy vehicle according to claim 12 wherein said device includes a manually operable release for releasing the target from said second position for movement to said first position.

14. A toy vehicle comprising:

a toy vehicle body;

a motor carried by said body and a battery carried by said body for powering the motor;

a plurality of targets carried by said vehicle body at spaced locations thereabout and movable between first and second positions;

a plurality of switches carried by said vehicle connecting in parallel said battery and said motor such that said motor receives power from said battery through said switches when closed, said switches being coupled to said targets, respectively, and movable into open positions in response to movement of said targets from said first position to said second position enabling the vehicle to be powered by said battery until a last of said switches is opened.

15. A toy vehicle according to claim 14 including a device for locking each target in said second position upon movement from said first position into said second position.

16. A toy vehicle according to claim 15 wherein said device includes a manually operable release for releasing the target from said second position for movement to said first position.

17. A toy vehicle according to claim 14 including a spring for biasing each target into said first position, a detent cooperable between said vehicle body and said target for releasably securing said target in said second position, said detent being responsive to movement of said target into said second position to lock said target in said second position.

18. A toy vehicle according to claim 17 wherein said device includes a manually operable release for releasing the target from said second position for movement to said first position.

* * * * *